US006505006B1

(12) United States Patent
Solanki et al.

(10) Patent No.: US 6,505,006 B1
(45) Date of Patent: Jan. 7, 2003

(54) SUPPLY CARTRIDGE FOR A PRINTING APPARATUS

(75) Inventors: Kamlesh Solanki, Watford (GB); Alan C. R. Howard, Beds (GB); Christopher Pearce, Herts (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/002,441

(22) Filed: Nov. 15, 2001

(51) Int. Cl.[7] ..... G03G 15/00
(52) U.S. Cl. ..... 399/12
(58) Field of Search ..... 399/12, 262, 110, 399/119, 120, 112, 86, 115

(56) References Cited

U.S. PATENT DOCUMENTS

| | | | | |
|---|---|---|---|---|
| 4,611,730 A | | 9/1986 | Ikesue et al. | 222/167 |
| 4,740,808 A | * | 4/1988 | Kasamura et al. | 399/12 |
| 5,289,242 A | | 2/1994 | Christensen et al. | 399/12 |
| D379,194 S | | 5/1997 | Sundquist et al. | D18/43 |
| 5,807,005 A | | 9/1998 | Wright | 400/668 |
| 5,857,129 A | * | 1/1999 | Harris | 399/12 |
| 6,006,046 A | * | 12/1999 | MacFarland | 399/12 |
| 6,009,285 A | | 12/1999 | Barry et al. | 399/12 |
| 6,023,594 A | * | 2/2000 | Okiyama et al. | 399/12 |
| 6,259,877 B1 | * | 7/2001 | Taniyama et al. | 399/262 |

FOREIGN PATENT DOCUMENTS

| | | |
|---|---|---|
| JP | 04-338989 | * 11/1992 |
| JP | 09-166903 | * 6/1997 |

* cited by examiner

*Primary Examiner*—Sophia S. Chen
(74) *Attorney, Agent, or Firm*—R. Hutter

(57) ABSTRACT

In office equipment such as printers and copiers, a single machine "platform" is available as a number of distinct variants (copier, printer, facsimile, MICR printer). Different variants may require different types of marking material cartridges, or other replaceable units. To prevent the installation of an unsuitable cartridge in a machine, each cartridge defines a distinguishing configuration of convex or concave engagement structures, arranged in a circle, but whereby no more than one-half of the circumference of the circle is taken up by the engagement structures. The engagement structures engage with complementary structures inside a suitable machine, and can assist in driving a rotation of the cartridge within the machine.

22 Claims, 4 Drawing Sheets

SUPPLY CARTRIDGE FOR A PRINTING APPARATUS

FIELD OF THE INVENTION

The present invention relates to office equipment such as printers and copiers, and specifically relates to replaceable cartridges, such as containing marking material such as ink or toner, which are installable in such equipment.

BACKGROUND OF THE INVENTION

In the office equipment industry, for every model of equipment, such as a copier, printer, facsimile, or multifunction device (all of the above being, to some extent, "printers") there is typically one or more parts which are intended to be removed and replaced readily by an end user. Typical among such parts is a supply cartridge for holding marking material used in the printing process, such as toner or liquid ink. Users purchase or otherwise obtain replacement cartridges and install them in their machines as needed.

It is common that a manufacturer or vendor will make available a "platform" of equipment, meaning a basic hardware structure on which a family of models is based. For instance, a basic print engine may be available in a copier version and a printer-only version; different basically-similar models may be designed to operate at different speeds; or different models may be adapted to use different types of marking material, such as color or MICR ink or toner. Some cartridges, particularly those containing marking material, may be inadvisable to use with different models within the same platform; however, in the interest of minimizing costs, it is desirable to make the cartridges for various models generally physically similar.

DESCRIPTION OF THE PRIOR ART

U.S. Pat. No. 4,611,730 discloses a toner replenishing device comprising a largely cylindrical container which is intended to rotate around an axis within a printer. Around the circumference of the cylinder is a set of gear teeth which is engaged by a drive gear in the printer. It is evident from the description that the gear teeth are intended to be provided around the entire cimcumference of the container.

U.S. Pat. No. 5,289,242 discloses a digital printer which is capable of printing in both regular and MICR modes. The MICR-material version of the marking material cartridge is distinguished by a conductive label which completes a test circuit when the cartridge is installed. When the test circuit is completed, the control system of the printer is advised that the MICR cartridge has been installed.

U.S. Pat. Nos. 5,807,005 and 6,009,285 disclose a digital printer in which a marking material cartridge includes an "encoder wheel" pivotably attached thereto, and which is caused to rotate upon installation of the cartridge. The encoder wheel includes a set of "digital indicators" which are caused to be sensed in sequence as the wheel rotates. The data collected by the printer from the encoder wheel controls the printer, including causing the printer to lock if a "wrong" type of cartridge is installed.

U.S. Pat. No. Des. 379,194, which relates to the Xerox® 5614™ copier, released in 1995, shows an example of a cartridge in a system whereby different versions of the same platform each use a different version of a supply cartridge. In this case, each version uses a supply cartridge where a small indentation is in a different position on the cartridge.

SUMMARY OF THE INVENTION

According to one aspect of the present invention, there is provided a removable cartridge suitable for use in a printing apparatus, comprising means defining a plurality of engagement structures, the engagement structures arranged around a circle, the plurality of engagement structures together occupying no more than half a circumference of the circle.

According to another aspect of the present invention, there is provided a method of operating a set of printing machines, each printing machine using a removable cartridge. For a first subset of printing machines, a first population of cartridges is provided, each of the first population of cartridges including means defining a plurality of engagement structures, the engagement structures arranged around a circle. For a second subset of printing machines, a second population of cartridges is provided, each of the second population of cartridges including means defining a plurality of engagement structures, the engagement structures arranged around a circle. For each of the first and second population of cartridges, the plurality of engagement structures together occupy no more than half a circumference of the circle. The engagement structures of the first population of cartridges are physically distinguishable from the engagement structures of the second population of cartridges.

DETAILED DESCRIPTION OF THE INVENTION

Figure 1:
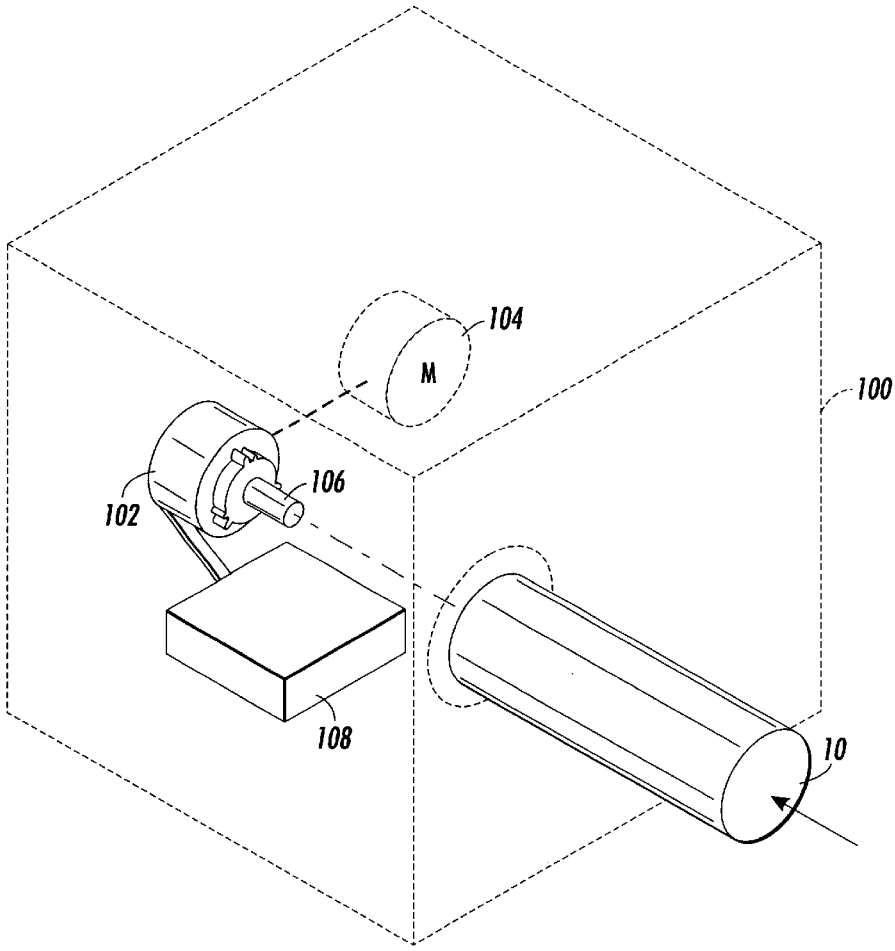
FIG. 1 is a simplified perspective view of the main elements of a printing apparatus relevant to the present invention.

FIG. 1 is a simplified perspective view of the main elements of a printing apparatus, or printer, 100 (which may include copying, fax, and other capabilities as well) relevant to the present invention. Printer 100 includes, in this embodiment, what can generally be called a cartridge interface 102, which generally accepts a removable cartridge 10.

If the cartridge 10 is a supply cartridge for marking material, such as toner in an electrophotographic printer or ink in an ink-jet printer, in some designs it is desirable to rotate, or otherwise alter the position of, the cartridge 10 while the printer is in use, such as to stir the marking material therein and cause the material to be dispensed from the cartridge 10. Although the specific means of rotating, stirring, and dispensing marking material within a rotatable cartridge 10 are not immediately germane to the present invention, examples of such devices and systems can be seen in U.S. Pat. Nos. 5,576,816; 5,740,506; and 5,613,177. Where it is desired to rotate a cartridge 10 within a machine 100, the cartridge interface 102 is driven, at various times, by a motor 104. In the illustrated embodiment, a collector 106 is inserted into an opening in the cartridge 10, to accept marking material therefrom. Marking material is then conveyed and dispensed, as needed, to the relevant portion of marking hardware, such as shown as 108, which may be, for example, a developer unit in an electrophotographic printer.

Figure 2:
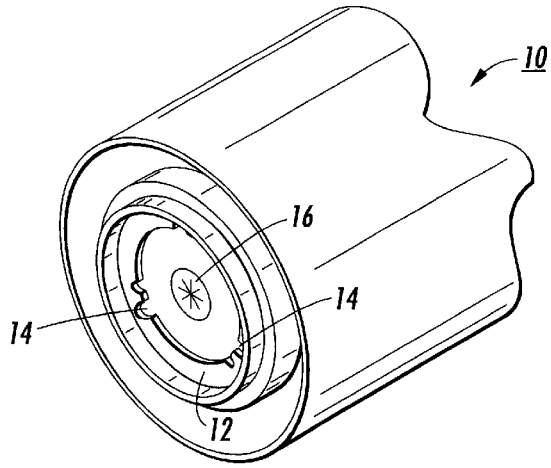
FIG. 2 is a perspective view of one end of a substantially cylindrical cartridge relevant to one embodiment of the present invention.

FIG. 2 is a perspective view of one end of a substantially cylindrical cartridge 10, relevant to one embodiment of the present invention. At the end surface of the cartridge 10 which contacts the cartridge interface 102 within the machine, there is what is here called a flange 12, which may be made integral with the body of cartridge 10, such as through molding. The flange 12 has defined therein a set of what are called "engagement structures" 14. In the illustrated embodiment, there are three physically identical engagement structures 14 which are arranged radially symmetrically around the circle formed by flange 12, which in turn is disposed around an opening 16 which accepts collector 106 in the machine, and which also represents the axis around which cartridge 10 rotates when driven by motor 104 via cartridge interface 102.

In one embodiment of the invention, whatever number of engagement structures 14 are defined in flange 12, the proportion of the total circumference of the circle formed in flange 12 taken up by the engagement structures 14 should be no more than one-half.

The engagement structures 14 effectively mate with, or in other words engage, complementary structures defined in the cartridge interface 102 (not shown) to allow a secure fit between the cartridge 10 and the interface 102. Moreover, if the machine is designed to rotate or otherwise alter the position of cartridge 10, a driving motion of cartridge interface 102 should at least in part drive the motion or the cartridge 10 via the engagement structures 14 (there may be provided, within machine 10, other hardware for rotating the cartridge as well).

Although FIG. 2 shows the engagement structures 14 in the form of pairs of concave surfaces, variants suitable for the invention can be imagined. The engagement structures 14 can be concave or convex, or include convex and concave portions; or, within a single cartridge 10 there may be defined both concave and convex engagement structures. Indeed, in order to permit the use of the engagement structures for driving the rotation of the cartridge 10, the engagement structures could include, for instance, high-friction or even magnetic elements which effectively engage with complementary structures in the cartridge interface 102.

Figure 3:
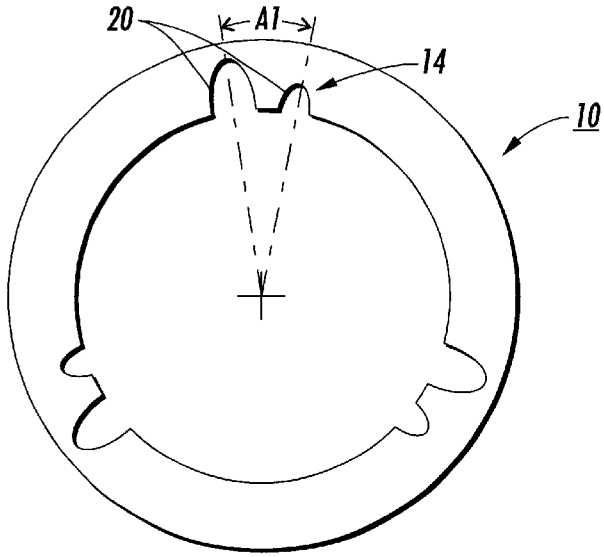
FIGS. 3 and 4 are end-on elevational views of two respective types of cartridges illustrating another aspect of the present invention.
Figure 4:
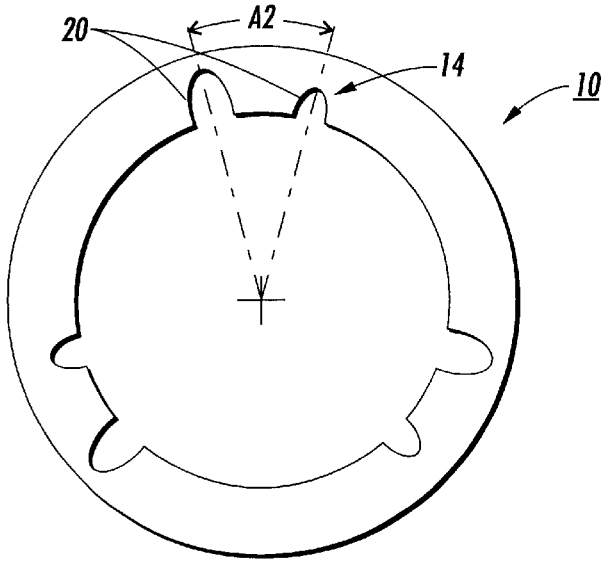
Figure 5:
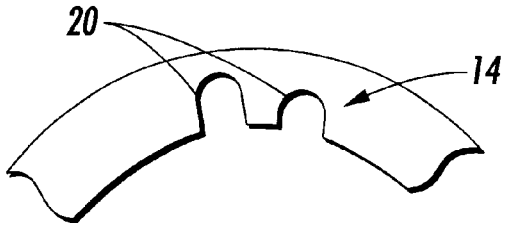
FIGS. 5–9 are simplified views of profiles of example engagement structures, illustrating other aspects of the present invention.
Figure 6:
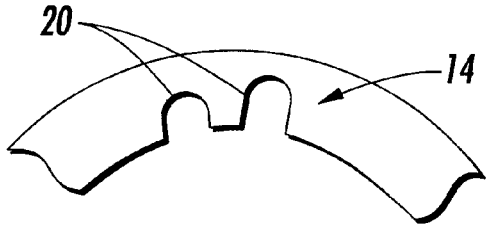

FIGS. 3 and 4 are end-on elevational views of two respective types of cartridges 10, illustrating another aspect of the present invention. The cartridges 10 in each Figure are essentially physically identical, but for the difference that the engagement structures for each cartridge 10 are physically distinguishable. Specifically, for each engagement structure 14, which in turn comprises first and second "contact structures" 20 (here, specially shaped concavities), the contact structures 20 in the FIG. 3 example are spaced by a first separation angle A1, while the contact structures 20 in the FIG. 4 example are spaced by a second, different, separation angle A2. In either case, in this embodiment of the invention, the engagement structures 14 are radially symmetrically arranged around a circle, while the proportion of the circumference of circle taken up by the engagement structures is less than one-half (one may or may not take into account the space between contact structures 20 in determining the proportion).

It is evident that a cartridge 10 made according to FIG. 3 will be physically incompatible with a machine 10 having a cartridge interface 102 which is shaped to accept cartridges of the FIG. 4 type, and vice-versa. Populations of cartridges such as of the type shown in FIGS. 3 and 4 respectively, or cartridges otherwise physically distinguishable according to the present invention, are useful in situations where a single hardware "platform" (i.e., the basic hardware of machine 10) is used in different situations, the different situations requiring different types of marking material or other attributes of cartridges. According to one aspect of the invention, while the basic shape of the cartridge 10 is compatible with all variants of the same platform, the engagement structures 12 permit only suitable cartridges to be installed in a particular type of machine in the platform.

Figure 7:
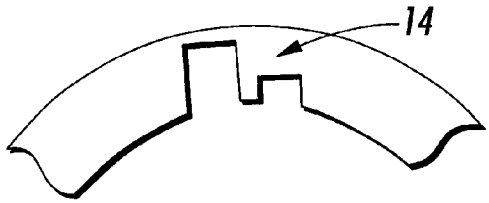
Figure 8:
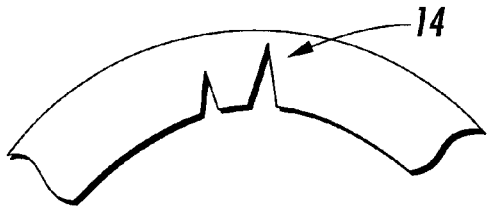

FIGS. 5–8 are simplified views of profiles of example engagement structures 14 (which may be concave, convex, or a combination thereof) showing different ways of manifesting differences in different populations of cartridges 10. The FIG. 5 and FIG. 6 profiles differ in that the two contact structures in each are mirrored relative to each other, as shown. FIGS. 7 and 8 show how different profile shapes define and distinguish a population of cartridges: the shapes associated with any aspect of an engagement structure 14 can include one or more "corners," as shown. Here, the term "corners" should be construed broadly to include any surface discontinuity or angle. Indeed, although, in the illustrated embodiments, the unique and distinguishing shapes of the various types of engagement structures are manifest in one-dimensional profiles, the engagement structures can define, in whole or in part, three-dimensional structures such as cones, ridges, truncated cones, pegs, etc. Also, although the engagement structures 14 are illustrated at an end surface of a largely cylindrical cartridge 10, such engagement structures may be alternately or additionally defined around a circumference of the cartridge.

Figure 9:
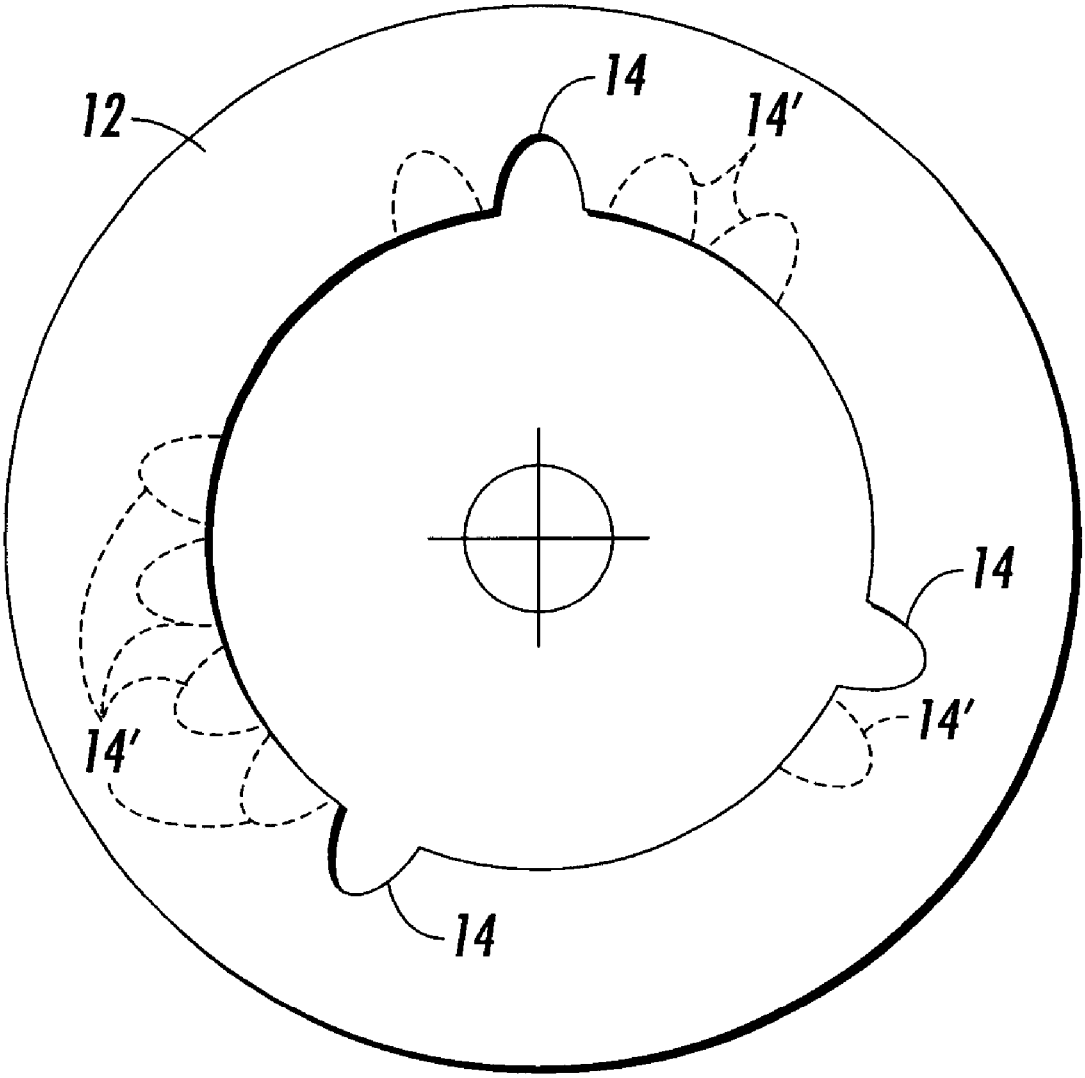

FIG. 9 shows another profile of engagement structures 14 arranged in a circle, illustrating another embodiment of the present invention. In the FIG. 9 embodiment, the configuration of engagement structures 14 for a first population of cartridges is shown in solid lines, while possible positions of engagement structures for other populations are shown in phantom. In short, for one population, engagement structures 14 can be radially symmetrically disposed around the circle, while, for other populations, the engagement structures 14' may in various ways be disposed in a non-symmetrical manner. In one possible embodiment, the engagement structures for different populations may be radially symmetrical in each case, but there may be provided different numbers of structures, such as 3, 4, or 5 engagement structures.

In overview, the configurations of engagement structures 14 on different populations of cartridges 10 provide novel practical advantages. The fact the engagement structures are provided on an end surface of a cylindrical cartridge allows the bulk of the cartridge to be similar for all populations. The fact that the engagement structures are arranged in a circle allow the engagement structure to be used to rotate the cartridge about a cylindrical axis. The fact the engagement structures take up less than half a circumference of the circle allows cartridges for different populations to be made with simple molding or stamping techniques, with just small changes required in the stamps or molds; the embodiment in which different populations are distinguished by different separation angles is particularly easy to manufacture in different types. It also permits the cartridges to be engaged with structures inside the machine with only a small amount of twisting of the cartridge (such as no more than ⅓ turn) to signal to the user whether a correct cartridge is attempted to be installed.

We claim:

1. A removable cartridge suitable for use in a printing apparatus, comprising:

means defining a plurality of engagement structures, each engagement structure having at least two contact structures, the engagement structures arranged around a circle, the plurality of engagement structures together occupying no more than half a circumference of the circle.

2. The cartridge of claim 1, wherein the cartridge is substantially cylindrical, and the engagement structures are defined at an end surface of the cartridge.

3. The cartridge of claim 1, the engagement structures arranged radially symmetrically around the circle.

4. The cartridge of claim 1, each of at least a subset of the engagement structures being suitable for engaging a complementary structure within a printing apparatus, the complementary structure being capable of assisting in altering a position of the cartridge within the printing apparatus.

5. The cartridge of claim 1, at least one of the engagement structures being concave.

6. The cartridge of claim 1, at least one of the engagement structures being convex.

7. The cartridge of claim 1, one of the two contact structures being larger than the other.

8. The method of claim 1, at least one of the two contact structures defining at least one corner.

9. The method of claim 1, each of at least a subset of the contact structures being suitable for engaging a complementary structure within a printing apparatus, the complementary structure being capable of assisting in altering a position of the cartridge within the printing apparatus.

10. The cartridge of claim 1, further comprising means defining an opening, the opening disposed substantially at a center of the circle.

11. The cartridge of claim 1, further comprising marking material disposed within the cartridge.

12. A method of operating a set of printing machines, each printing machine using a removable cartridge, comprising the steps of:

for a first subset of printing machines, providing a first population of cartridges, each of the first population of cartridges including means defining a plurality of engagement structures, the engagement structures arranged around a circle, and wherein each of the cartridges comprises means defining an opening, the opening disposed substantially at a center of the circle;

for a second subset of printing machines, providing a second population of cartridges, each of the second population of cartridges including means defining a plurality of engagement structures, the engagement structures arranged around a circle;

for each of the first and second population of cartridges, the plurality of engagement structures together occupying no more than half a circumference of the circle;

wherein the engagement structures of the first population of cartridges are physically distinguishable from the engagement structures of the second population of cartridges.

13. The method of claim 12, wherein each of the first and second population of cartridges is substantially cylindrical, and the engagement structures are defined at an end surface of the cylindrical cartridge.

14. The method of claim 12, wherein each of the cartridges comprises marking material.

15. The method of claim 12, wherein the cartridges of the first population and the cartridges of the second population are substantially physically indistinguishable, except for the engagement structures.

16. The method of claim 12, wherein, for the first and second population of cartridges, the plurality of engagement structures together occupy no more than half a circumference of the circle.

17. The method of claim 12, wherein, for the first and second population of cartridges, each of at least a subset of the engagement structures are suitable for receiving a complementary structure within a printing machine, the complementary structure being capable of assisting in altering a position of the cartridge within the printing machine.

18. The method of claim 12, wherein the cartridges of the first population include a first number of engagement structures which are arranged radially symmetrically around a circle and the cartridges of the second population include a second number of engagement structures which are arranged radially symmetrically around a circle.

19. The method of claim 12, wherein the cartridges of the first population and the cartridges of the second population contain marking material suitable for electrophotographic printing.

20. A method of operating a set of printing machines, each printing machine using a removable cartridge, comprising the steps of:

for a first subset of printing machines, providing a first population of cartridges, each of the first population of cartridges including means defining a plurality of engagement structures, the engagement structures arranged around a circle;

for a second subset of printing machines, providing a second population of cartridges, each of the second population of cartridges including means defining a plurality of engagement structures, the engagement structures arranged around a circle;

for each of the first and second population of cartridges, the plurality of engagement structures together occupying no more than half a circumference of the circle;

wherein, for the first and second population of cartridges, each of at least a subset of the engagement structures define at least two contact structures, and wherein the two contact structures are separated by a separation angle around the circle; and wherein the separation angle associated with the first population is different from the separation angle associated with the second population.

21. The method of claim 20, wherein the cartridges of the first population and the cartridges of the second population are substantially physically indistinguishable, except for the separation angle.

22. A method of operating a set of printing machines, each printing machine using a removable cartridge, comprising the steps of:

for a first subset of printing machines, providing a first population of cartridges, each of the first population of cartridges including means defining a plurality of engagement structures, the engagement structures arranged around a circle;

for a second subset of printing machines, providing a second population of cartridges, each of the second population of cartridges including means defining a plurality of engagement structures, the engagement structures arranged around a circle;

for each of the first and second population of cartridges, the plurality of engagement structures together occupying no more than half a circumference of the circle;

wherein the cartridges of the first population include engagement structures which are arranged radially symmetrically around a circle and the cartridges of the second population include engagement structures which are not arranged radially symmetrically around a circle.

* * * * *